US009510985B2

(12) United States Patent
Maither

(10) Patent No.: US 9,510,985 B2
(45) Date of Patent: Dec. 6, 2016

(54) SYSTEM OF ADAPTABLE MODULAR UTILITY DEVICES

(71) Applicant: Mark Maither, Pinellas Park, FL (US)

(72) Inventor: Mark Maither, Pinellas Park, FL (US)

(73) Assignee: Thomas Paul Cogley, DVM, Pinellas Park, FL (US)

( * ) Notice: Subject to any disclaimer, the term of this patent is extended or adjusted under 35 U.S.C. 154(b) by 0 days.

(21) Appl. No.: 15/007,144

(22) Filed: Jan. 26, 2016

(65) Prior Publication Data

US 2016/0213535 A1 Jul. 28, 2016

Related U.S. Application Data

(60) Provisional application No. 62/108,764, filed on Jan. 28, 2015.

(51) Int. Cl.

| | |
|---|---|
| ***A61G 5/04*** | (2013.01) |
| ***A61G 5/14*** | (2006.01) |
| ***A61G 5/10*** | (2006.01) |
| ***A61G 5/12*** | (2006.01) |
| ***A61G 7/10*** | (2006.01) |

(52) U.S. Cl.

CPC . *A61G 5/14* (2013.01); *A61G 5/04* (2013.01); *A61G 5/10* (2013.01); *A61G 5/12* (2013.01); *A61G 7/1015* (2013.01); *A61G 2005/1051* (2013.01); *A61G 2005/1094* (2013.01); *A61G 2005/128* (2013.01); *A61G 2203/12* (2013.01); *A61G 2203/80* (2013.01)

(58) Field of Classification Search

CPC .... B62K 15/00; B62K 15/008; B62K 5/007; B60B 21/12; B60B 3/10; B60B 19/06

See application file for complete search history.

(56) References Cited

U.S. PATENT DOCUMENTS 3,921,740 A * 11/1975 Forster ..... A61G 3/061 180/213

* cited by examiner

*Primary Examiner* — John Walters
*Assistant Examiner* — James Triggs

(57) ABSTRACT

A foot support is disposed in a horizontal plane and is positioned on a housing of the lower section of a motorized wheel chair rearwardly of upwardly facing receptors. A control post has a lower end removably received in the receptors and an upper end having an upper cross piece with spaced hand grips. A control assembly is coupled to the upper cross piece. A motor within the housing powers laterally spaced drive wheels. A steerer within the housing directs directional wheels. The control assembly includes a drive wheel controller for varying the speed of the system and a directional wheel controller for varying the direction of the system.

7 Claims, 5 Drawing Sheets

FIG. 3
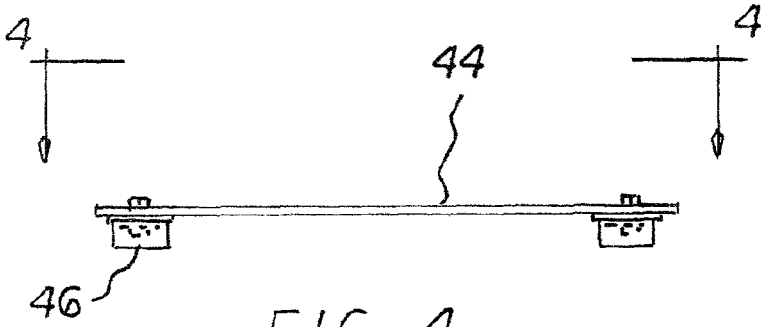
FIG. 4
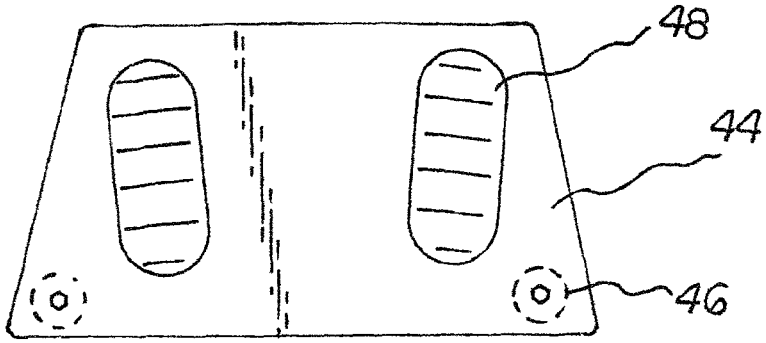
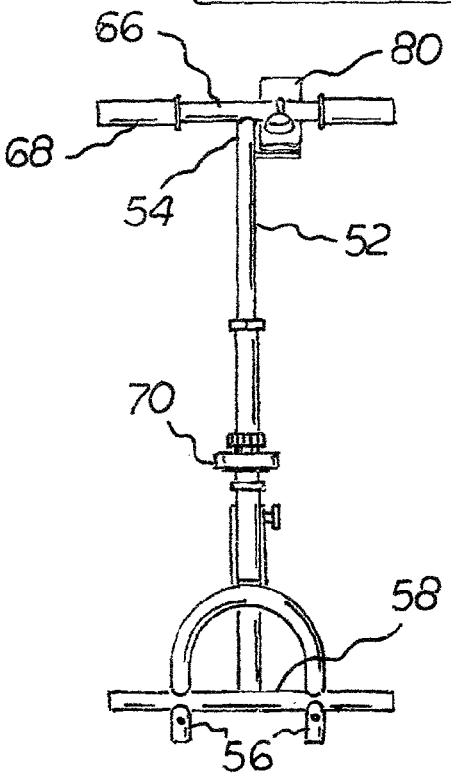
FIG. 5
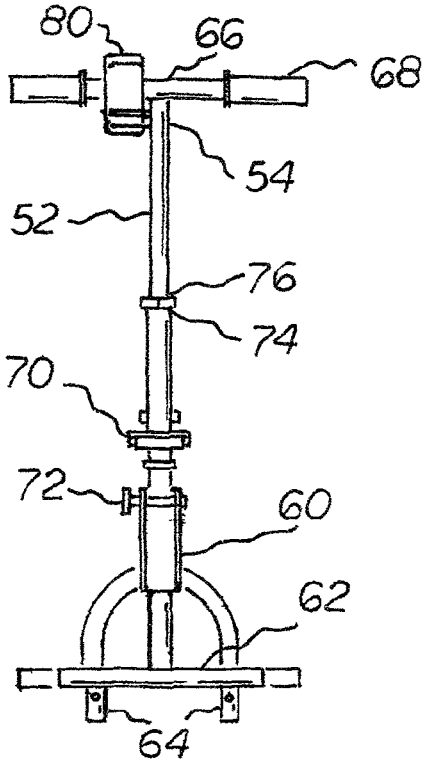
FIG. 6

SYSTEM OF ADAPTABLE MODULAR UTILITY DEVICES

RELATED APPLICATION

This application is based upon and claims the benefit of Provisional Application No. 62/108,764 filed Jan. 28, 2015, the subject matter of which is incorporated herein by reference.

BACKGROUND OF THE INVENTION

Field of the Invention

The present invention relates to a system of adaptable modular utility devices and more particularly pertains to supporting a user while standing and for transporting the standing, supported user, the supporting and transporting being done in a safe, convenient, and economical manner.

Description of the Prior Art

The use of modular utility devices of known designs and configurations is known in the prior art. More specifically, modular utility devices of known designs and configurations previously devised and utilized for the purpose of supporting and transporting a standing user are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, the aforementioned patents do not describe a system of adaptable modular utility devices that allows supporting a user while standing and for transporting the standing, supported user, the supporting and transporting being done in a safe, convenient, and economical manner.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

Therefore, it can be appreciated that there exists a continuing need for a new and improved system of adaptable modular utility devices which can be used for supporting a user while standing and for transporting the standing, supported user, the supporting and transporting being done in a safe, convenient, and economical manner. In this regard, the present invention substantially fulfills this need.

SUMMARY OF THE INVENTION

In view of the disadvantages inherent in the known types of modular utility devices of known designs and configurations now present in the prior art, the present invention provides an improved system of adaptable modular utility devices. As such, the general purpose of the present invention, which will be described subsequently in greater detail, is to provide a new and improved system of adaptable modular utility devices and method which has all the advantages of the prior art and none of the disadvantages.

In a broad context, the present invention essentially comprises a foot support positioned on the housing rearwardly of the receptors. The foot support is disposed in a horizontal plane. A control post has upper and lower ends. The lower end is removably received in the receptors. The upper end has an upper cross piece with spaced hand grips. A control assembly is coupled to the upper cross piece. A motor within the housing for powering the drive wheels. A steerer within the housing directs the directional wheels. The control assembly includes a drive wheel controller for varying the speed of the system and a directional wheel controller for varying the direction of the system.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the invention be regarded as including such equivalent constructions insofar as they do not depart from the spirit and scope of the present invention.

It is therefore an object of the present invention to provide a new and improved system of adaptable modular utility devices which has all of the advantages of the prior art modular utility devices of known designs and configurations and none of the disadvantages.

It is another object of the present invention to provide a new and improved system of adaptable modular utility devices which may be easily and efficiently manufactured and marketed.

It is further object of the present invention to provide a new and improved system of adaptable modular utility devices which is of durable and reliable constructions.

An even further object of the present invention is to provide a new and improved system of adaptable modular utility devices which is susceptible of a low cost of manufacture with regard to both materials and labor, and which accordingly is then susceptible of low prices of sale to the consuming public, thereby making such system of adaptable modular utility devices economically available to the buying public.

Lastly, it is an object of the present invention to provide a new and improved system of adaptable modular utility devices for supporting a user while standing and for transporting the standing, supported user, the supporting and transporting being done in a safe, convenient, and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a rear elevational view taken along line 3-3 of FIG. 2.

FIG. 4 is a plan view taken along line 4-4 of FIG. 3.

FIG. 5 is a front elevational view taken alone line 5-5 of FIG. 2.

FIG. 6 is a rear elevational view taken along line 6-6 of FIG. 2.

The same reference numerals refer to the same parts throughout the various Figures.

DESCRIPTION OF THE PREFERRED EMBODIMENT

Figure 1:
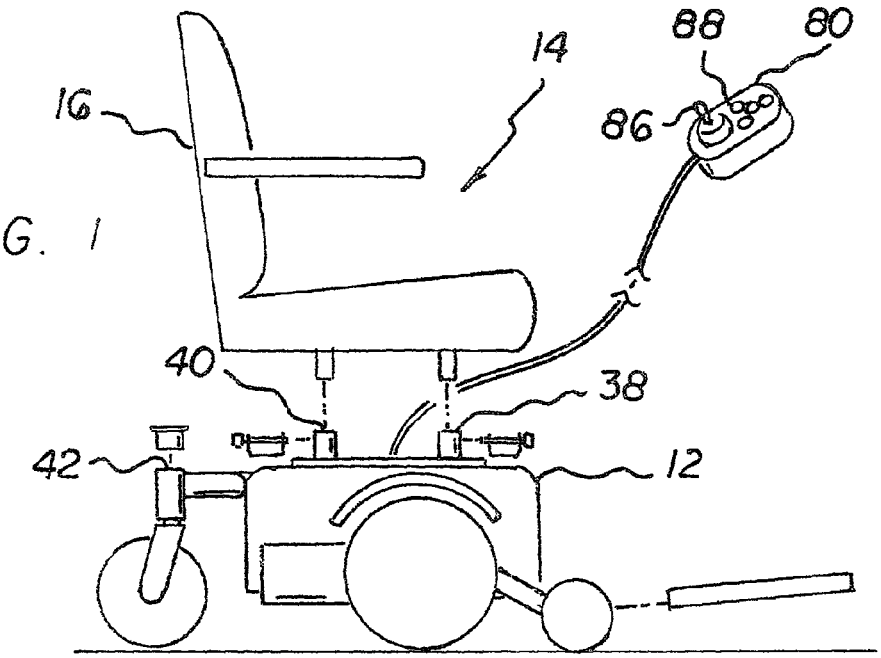
FIG. 1 is an exploded perspective illustration of a motorized wheel chair which includes a lower section for use in a system of adaptable modular utility devices constructed in accordance with the principles of the present invention.
Figure 2:
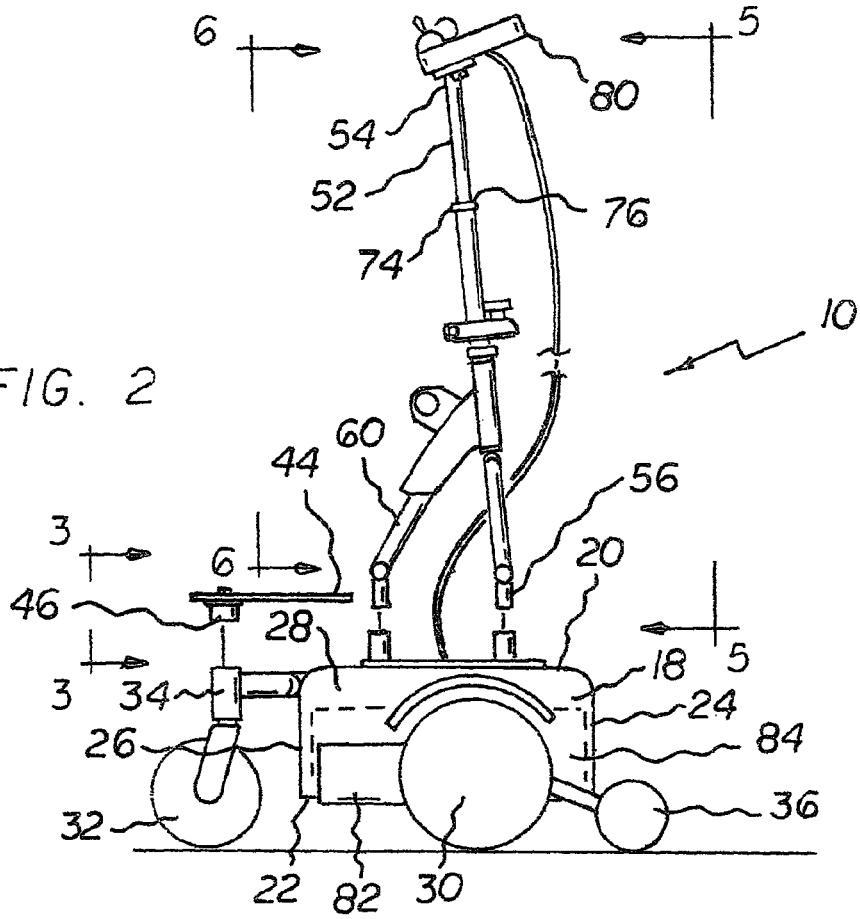
FIG. 2 is an exploded perspective illustration of a system of adaptable modular utility devices constructed in accordance with the principles of the present invention.
Figure 7:
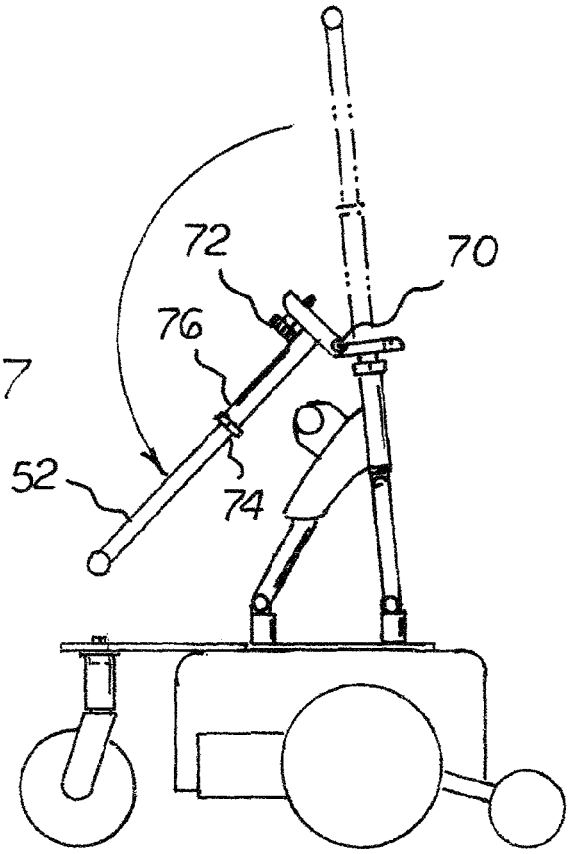
FIG. 7 is a side elevational view with the control post pivoted into a lowered orientation.

With reference now to the drawings, and in particular to FIG. 1 thereof, the preferred embodiment of the new and improved system of adaptable modular utility devices embodying the principles and concepts of the present invention and generally designated by the reference numeral 10 will be described.

The present invention, the system of adaptable modular utility devices 10 is comprised of a plurality of components. Such components are individually configured and correlated with respect to each other so as to attain the desired objective. In their broadest context such include a foot support, a control post and a control assembly. Such components are individually configured and correlated with respect to each other so as to attain the desired objective.

The preferred embodiment of the system of adaptable modular utility devices is for supporting a user while standing and for transporting the standing, supported user, the supporting and transporting being done in a safe, convenient and economical manner. The system is designated by reference numeral 10. First provided is a lower section 12 of a motorized wheel chair 14. The motorized wheel chair is of the type having an upper chair 16 adapted to be removed and set aside. The lower section has a rectilinear housing 18 formed with a closed top 20, an open bottom 22, a front face 24, a rear face 26 and spaced side faces 28. Two laterally spaced drive wheels 30 extend laterally from the side faces. Two laterally spaced casters 32 are provided. Caster supports 34 extend rearwardly from the rear face coupling the casters to the housing. Two laterally spaced directional wheels 36 extend forwardly from the front face. Two laterally spaced forward receptors 38 face upwardly from the top of the housing adjacent to the front face. Two laterally spaced rearward receptors 40 face upwardly from the top of the housing adjacent to the rear face. Two laterally spaced supplemental receptors 42 face upwardly from the caster supports. The housing is fabricated of a rigid metallic material.

Next provided is a foot support 44. The foot support is in a trapezoidal configuration having a wide rear end and a narrow front end. Two laterally spaced footer projections 46 extend downwardly from the rear end. The front end is positioned on the top of the housing rearwardly of the rearward receptors. The foot support is disposed in a horizontal plane during operation and use. The foot support has an upper surface with elastomeric foot receiving areas 48. The foot support is fabricated of a rigid metallic material.

A control post 52 is next provided. The control post has an upper end 54 and a forward forked lower end 56 with a forked cross piece 58. The forward forked lower end is removably received in the forward receptors. A stabilizer 60 is provided. The stabilizer has an upper end coupled to an intermediate extent of the control post. The stabilizer has a rearward cross piece 62 with a rearward forked lower end 64 removably received in the rearward receptors. The upper end of the control post has an upper cross piece 66 with spaced hand grips 68 for the hands of the user. The control post has a pivotable region 70 with a locking pin 72 located above the forward forked lower end. The control post has a variable length region 76 with a rotatable locking collar 74 located above the pivotable region.

Next provided is a control assembly 80 secured to the upper cross piece between the hand grips. A motor 82 is provided within the housing for driving the wheels. The control assembly includes a wheel controller 84 for varying the speed of the system, a steering controller 86 within the housing for directing the directional wheels, and a directional controller 88 for varying the direction of the system.

An option 100 includes a seat 104. The seat has a forward J-shaped finger 106 removably coupled to the stabilizer. The seat has a rearward L-shaped leg 108 removably positioned upon the foot rest.

Lastly, an option 200 includes a wire basket 204 in a rectilinear configuration. The wire basket includes two rearwardly extending laterally spaced fingers 206. The laterally spaced fingers are rotatably received on the forward cross piece laterally exterior of the forward forked lower end to allow rotation of the wire basket between a lower operative orientation and a raised inoperative orientation.

Figure 8:
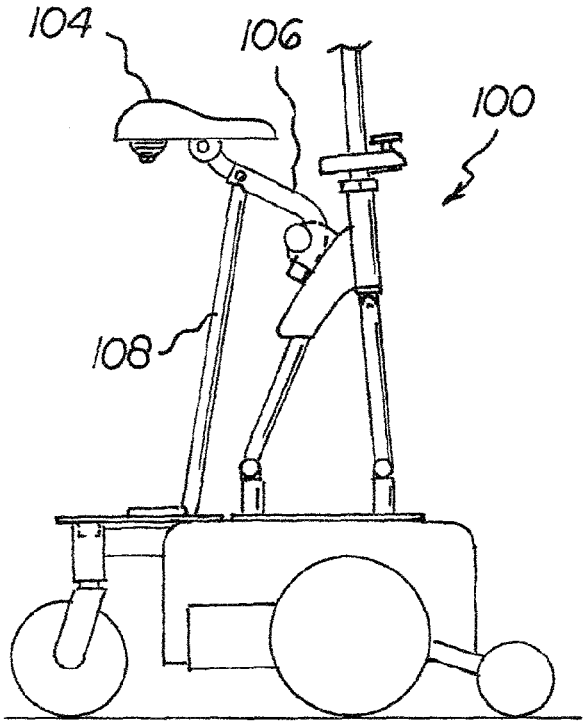
FIGS. 8 and 9 are side elevational views of an alternate seat embodiment of the invention.
Figure 9:
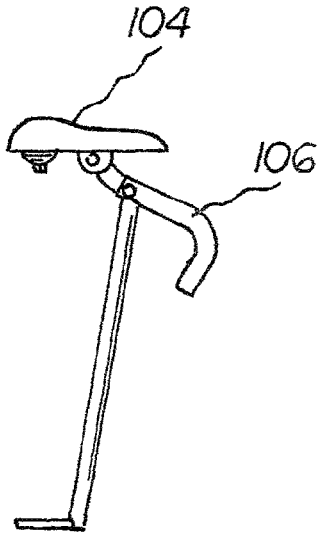
Figure 10:
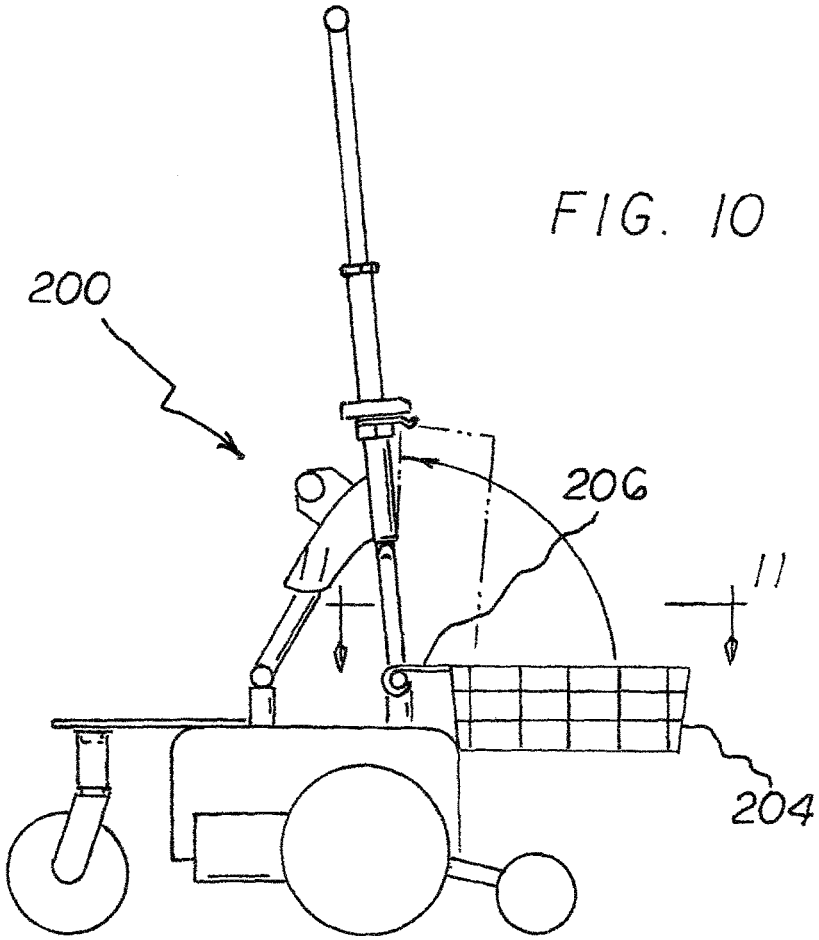
FIG. 10 is a side elevational view of another alternate basket embodiment of the present invention.
Figure 11:
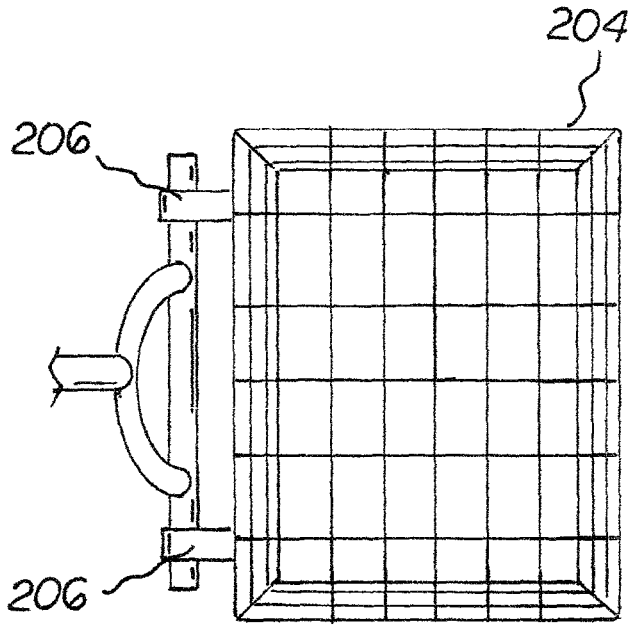
FIG. 11 is a plan view taken along line 11-11 of FIG. 10.
Figure 12:
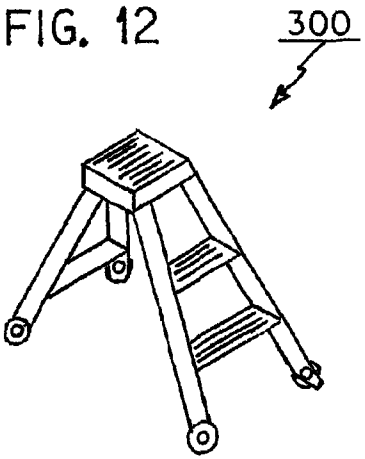
FIG. 12 is a perspective view of a ladder option for the system of the present invention.

The present invention is intended to be applied to existing mobile power movers such as wheelchair bases and anything similar. As illustrated herein, the system is adapted to be configured with a wide variety of options such as the seat of FIGS. 8 and 9 and the basket of FIGS. 10 and 11. Other options include a pull option with a trailer ball attachment for home use plate with hitch ball. Sub-options are a trailer mover and a boat trailer mover. Another option is a ladder option for elevated maintenance plate with a three step ladder 300. Such ladder preferably has wheels for ease of movement. A chamber is formed behind the steps for storage of tools and the like. A door may be provided for the security of the stored tools in the chamber. Note FIG. 12.

Still another option is a people mover option with foldable pole and control on plate. Sub options are an umbrella, seat, carriage, maid shelves, tool boxes and trailer option for use with any type of profession requiring tools and mobility.

Lastly, additional options include a cart caddy, paraplegic upright option, trash can cart mover, drone adaptor, police and military munitions visualization device, etc.

Figure 13:
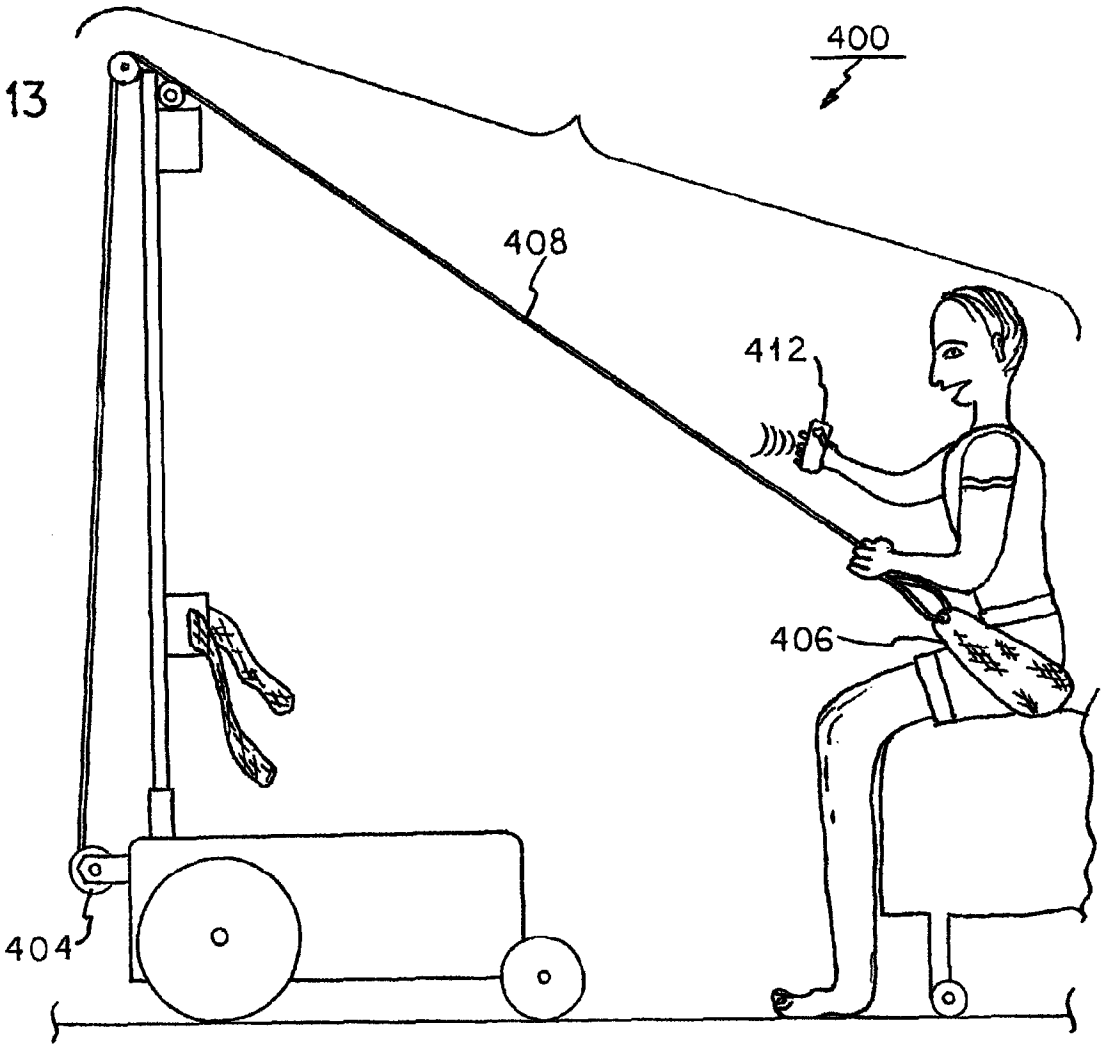
FIG. 13 is a side elevational view of an alternate embodiment with a sling to assist in user movement.

A final alternate embodiment is an assembly 400 for a paraplegic user. Note FIG. 13. Such assembly includes a winch 404, a sling 406, and a cable 408 between the winch and the sling. In operation, a user positions the sling adjacent to his or her appropriate body part, such as a back, waist, or bottom. The user then employs a remote device 412 to activate the winch to draw in the cable and sling to thereby assist the user in moving to the housing for transportation purposes. Straps with hook and loop fasteners help keep the user on the housing during transportation.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A system of adaptable modular utility devices for use with a lower section of a motorized wheel chair of the type having a housing with laterally spaced drive wheels and laterally spaced directional wheels, the housing having upwardly facing receptors, the system comprising:

a foot support positioned on the housing rearwardly of the receptors, the foot support being disposed in a horizontal plane;

a control post having upper and lower ends, the lower end being forked with a forked cross piece removably received in the receptors, the upper end having an upper cross piece with spaced hand grips;

a control assembly coupled to the upper cross piece, a motor within the housing for powering the drive wheels, a steerer within the housing for directing the directional wheels, the control assembly including a drive wheel controller for varying the speed of the system and a directional wheel controller for varying the direction of the system; and a stabilizer having an upper end coupled to the control post and a rearward cross piece removably received in the receptors the control post having a pivotable region with a locking pin, the control post having a variable length region with a rotatable locking collar located above the pivotable region.

2. The system as set forth in claim 1 wherein:

the foot support is in a trapezoidal configuration having a wide rear end and a narrow front end, two laterally spaced footer projections (46) extend downwardly from the rear end, the front end is positioned on the top of the housing rearwardly of the receptors, and the foot support has an upper surface with elastomeric foot receiving areas.

3. A system of adaptable modular utility devices (10) for supporting a user while standing and for transporting the standing, supported user, the supporting and transporting being done in a safe, convenient and economical manner, the system comprising, in combination:

a lower section (12) of a motorized wheel chair (14), the motorized wheel chair being of the type having an upper chair (16) adapted to be removed and set aside, the lower section having a rectilinear housing (16) formed with a closed top (20), an open bottom (22), a front face (24), a rear face (26) and spaced side faces (28), two laterally spaced drive wheels (30) extending laterally from the side faces, two laterally spaced casters (32), caster supports (34) extending rearwardly from the rear face coupling the casters to the housing, two laterally spaced directional wheels (36) extending forwardly from the front face, two laterally spaced forward receptors (38) facing upwardly from the top of the housing adjacent to the front face, two laterally spaced rearward receptors (40) facing upwardly from the top of the housing adjacent to the rear face, two laterally spaced supplemental receptors (42) facing upwardly from the caster supports, the housing being fabricated of a metallic material;

a foot support (44) in a trapezoidal configuration having a wide rear end and a narrow front end, two laterally spaced footer projections (46) extending downwardly from the rear end, the front end being positioned on the top of the housing rearwardly of the rearward receptors, the foot support being disposed in a horizontal plane during operation and use, the foot support having an upper surface with elastomeric foot receiving areas (48), the foot support being fabricated of a metallic material;

a control post (52) having an upper end (54) and a forward forked lower end (56) with a forked cross piece (58), the forward forked lower end being removably received in the forward receptors, a stabilizer (60) having an upper end coupled to an intermediate extent of the control post, the stabilizer having a rearward cross piece (62) with a rearward forked lower end (64) removably received in the rearward receptors, the upper end of the control post having an upper cross piece (66) with spaced hand grips (68) for the hands of the user, the control post having a pivotable region (70) with a locking pin (72) located above the forward forked lower end, the control post having a variable length region (76) with a rotatable locking collar (74) located above the pivotable region; and a control assembly (80) secured to the upper cross piece between the hand grips, a motor (82) within the housing for driving the wheels, the control assembly including a wheel controller (84) for varying the speed of the system, a steering controller (86) within the housing for directing the directional wheels, the control assembly including a directional controller (88) for varying the direction of the system.

4. The system (100) as set forth in claim 1 and further including a seat (104), the seat having a forward J-shaped finger (106) removably coupled to the stabilizer, the seat having a rearward L-shaped leg (108) removably positioned upon the foot rest.

5. The system (200) as set forth in claim 4 and further including a wire basket (204) in a rectilinear configuration, the wire basket including two rearwardly extending fingers (206), the laterally spaced fingers being rotatably received on the forward cross piece laterally exterior of the forward forked lower end to allow rotation of the wire basket between a lower operative orientation and a raised inoperative orientation.

6. The system as set forth in claim 4 and further including a ladder (300) on wheels for maintenance purposes.

7. The system as set forth in claim 4 and further including an assembly (400) with a winch (404) and a sling (406) and a cable (408) coupling the sling to the winch to assist a user in moving to the housing, the system further including a remote device (412) to activate and inactivate the winch.

* * * * *